US005975286A

United States Patent [19]

Oliff

[11] Patent Number: 5,975,286

[45] Date of Patent: Nov. 2, 1999

[54] PANEL INTERLOCKING ARRANGEMENT HAVING MEANS FOR PRESSING LOCKING TAB WINGS

[76] Inventor: James R. Oliff, Mead Packaging, P.O. Box 4417, Atlanta, Ga. 30302

[21] Appl. No.: 09/198,675

[22] Filed: Nov. 23, 1998

[51] Int. Cl.[6] ..... B65D 5/42

[52] U.S. Cl. ..... 206/140; 206/427

[58] Field of Search ..... 206/140, 147, 206/427, 434; 229/103.2, 198.2

[56] References Cited

U.S. PATENT DOCUMENTS

| | | | |
|---|---|---|---|
| 3,589,593 | 6/1971 | Weiss | 229/40 |
| 3,692,232 | 9/1972 | Helms | 229/52 B |
| 4,077,095 | 3/1978 | Oliff | 229/103.2 |
| 4,093,116 | 6/1978 | Watkins et al. | 229/198.8 |
| 4,200,220 | 4/1980 | Ganz | 206/427 |
| 4,330,079 | 5/1982 | Wood | 206/427 |
| 4,433,807 | 2/1984 | Ganz | 206/140 |
| 4,516,718 | 5/1985 | Forbes, Jr. | 229/146 |
| 4,869,423 | 9/1989 | Marie | 206/140 |
| 4,878,612 | 11/1989 | Schuster | 206/427 |
| 5,311,994 | 5/1994 | Oliff | 206/427 |
| 5,328,080 | 7/1994 | Holley, Jr. | 229/103.2 |
| 5,364,022 | 11/1994 | Ganz | 229/198.2 |
| 5,437,363 | 8/1995 | Gungner | 206/140 |
| 5,671,845 | 9/1997 | Harris | 206/140 |
| 5,765,685 | 6/1998 | Roosa | 206/434 |
| 5,782,343 | 7/1998 | Harrelson | 206/140 |

FOREIGN PATENT DOCUMENTS

| | | | |
|---|---|---|---|
| 3407348A1 | 11/1984 | Germany | 229/103.2 |

*Primary Examiner*—David T. Fidei
*Attorney, Agent, or Firm*—Tsugihiko Suzuki

[57] ABSTRACT

A panel interlocking arrangement includes first and second panels to be disposed in an overlapping relationship and a pair of locking and retaining tabs struck from the first and second panels, respectively. The retaining tab defines in the second panel a locking aperture for receiving the locking tab. The locking tab is foldably joined along a fold line to the first panel and extends to its free end edge opposed to the fold line. The locking tab includes a wing defined along one of its opposite side edges. The wing extends away from the free edge of the locking tab beyond the fold line. One of the end edges of the locking aperture is adapted to engage the locking tab when the locking tab is received in the locking aperture whereas the other end edge of the locking aperture is foldably joined to the retaining tab. The retaining tab extends from the other end edge of the aperture to its distal end edge. The retaining tab is adapted to be engaged at its distal edge with one of the opposite surfaces of the locking tab when the one end edge of the aperture is in engagement with the locking tab. The locking aperture is provided with an edge for pressing the wing of the locking tab toward the other end edge of the aperture when the one end edge of the aperture is in engagement with the locking tab.

17 Claims, 5 Drawing Sheets

PANEL INTERLOCKING ARRANGEMENT HAVING MEANS FOR PRESSING LOCKING TAB WINGS

BACKGROUND OF THE INVENTION

The present invention relates generally to panel interlocking arrangements by which a pair of panels can be secured together in an overlapping relationship, and more particularly to an interlocking arrangement for panels wherein a winged locking tab forms a cooperative locking engagement with a retaining tab while being engaged at its base by a portion of the perimeter of a locking aperture and at its wing by another portion of the perimeter. The present invention also relates to a carton employing the interlocking arrangement and a carton blank from which the carton is formed.

In the packaging of articles, and particularly of one or more articles in wrap-around type paperboard cartons, interlocking arrangements are frequently used for maintaining closure of the carton about the articles. It can be appreciated that such interlocking arrangements must be securely and reliably engaged, and must remain in such condition until the carton is opened.

One well-known form of interlocking arrangement comprises a locking tab and a cooperating retaining tab. An example of this type of locking arrangement can be seen in U.S. Pat. No. 4,077,095 which is hereby incorporated by reference. In this patent, first and second opposite end panels of a blank are secured together in an overlapping relationship by locking and retaining tabs. The locking tab is struck from and foldably joined to the first panel whereas the retaining tab is struck from and foldably joined to the second panel. A locking aperture is defined by the retaining tab in the second panel. The blank is applied to a group of articles, and then the first and second panels are brought into an overlapping relationship whereupon the locking tab is folded into the locking aperture. Upon insertion of the locking tab, the retaining tab is thrust aside and is thereby also folded to bring its distal end into abutment against the lower side of the locking tab. By this means, the locking tab is retained in the folded position in the locking aperture with the perimeter of the aperture in engagement with the locking tab.

Wraparound cartons are tightly wound around groups of articles with no slack to assure that the articles are held inside the cartons. Therefore, the interlocking arrangement such as mentioned above continually undergoes tension. If a carton with such an interlocking arrangement is subjected to vibration during, for example, its transportation, the locking tab could be unfolded to some degree, which in the worst case could result in disengagement of the retaining tab from the underside of the locking tab. Once the tabs are disengaged, the carton could be loosened to the extent that the accommodated articles are dislodged from the carton.

What is needed, therefore, is an improved panel interlocking arrangement wherein unfolding of the locking tabs are resisted to ensure against disengagement of the tabs.

SUMMARY OF THE INVENTION

The invention in one form provides a panel interlocking arrangement that can substantially reduce the risk of unfolding of a locking tab. The interlocking arrangement comprises first and second panels to be disposed in an overlapping relationship and a pair of locking and retaining tabs struck from the first and second panels, respectively. The locking tab is foldably joined to the first panel along a fold line and extends to its free end edge opposed to the fold line. The locking tab includes a wing defined along one of its opposite side edges. The wing extends away from the free edge of the locking tab beyond the fold line. The retaining tab defines in the second panel a locking aperture for receiving the locking tab. The locking aperture has a first end edge for engagement with the locking tab when the locking tab is folded and received in the locking aperture and a second end edge opposed to the first end edge and foldably joined to the retaining tab. The retaining tab extends from the second end edge of the aperture to its distal end edge. The retaining tab is adapted to be engaged at its distal end edge with one of the opposite surfaces of the locking tab when the first end edge of the aperture is brought into engagement with the locking tab. In this manner, the retaining tab will serve as a brace for retaining the locking tab in engagement with the first end edge of the aperture. The arrangement further comprises means for pressing the wing toward the second end edge of the aperture when the first end edge of the aperture is brought into engagement with the locking tab. The wing, when pressed, will be displaced out of the plane of the locking tab and form an additional brace for retaining the locking tab 32 in engagement with the first end edge. This additional brace will substantially reduce the risk of unfolding of the locking tab.

The pressing means may be a shoulder disposed adjacent to the first end edge of the aperture and projecting into the locking aperture. The shoulder may have a pressing edge offset from the first end edge of the aperture toward the second end edge. Alternatively, the pressing means may be a third edge of the locking aperture adjacent to the first end edge. Such a third edge may be offset from the first end edge toward the second end edge.

The wing may be partially severed from the locking tab by a slit extending from the fold line toward the free end edge of the locking tab.

The locking tab may further include a second wing along the other side edge of the locking tab. The second wing may have virtually the same features as the first wing. A second means may be provided for pressing the second wing toward the second end edge of the aperture when the first end edge is brought into engagement with the locking tab. The width of the locking tab at the wings may be less than the maximum width of the locking aperture. Alternatively, the locking tab may further include an ear along the other side edge of the locking tab. The ear may project laterally from the other side edge to provide a stopper for preventing the locking tab from being withdrawn from the locking aperture. In this embodiment, the width of the locking tab at the ear may preferably be greater than the maximum width of the locking aperture.

The present invention in a second form provides a carton comprising first and second overlapping panels and locking means for securing the panels together in interlocking engagement. The locking means comprises a pair of locking and retaining tabs struck from the first and second panels, respectively. The locking tab is foldably joined to the first panel and extends to its free end edge. The locking tab includes a wing defined along one of its opposite side edges. The wing extends away from the free edge of the locking tab. The retaining tab defines a locking aperture in the second panel. The locking aperture has first and second opposed end edges and a third edge. The third edge of the aperture is located adjacent to the first end edge such that it is offset from the first end edge of the aperture toward the second end edge. The retaining tab is foldably joined to the second panel along the second end edge of the aperture and extending to its distal end edge. The locking tab is disposed in the folded position where it is received in the locking aperture and in engagement with the first end edge of the aperture. The retaining tab is disposed in the folded position where it is in engagement at its distal end edge with one of the opposite surfaces of the locking tab, retaining the locking tab in its folded position. The wing of the locking tab extends through the locking aperture and is pressed against the third edge of the aperture to assist in retaining the locking tab in its folded position.

In this aspect of the invention, the wing of the locking tab may be pressed by the third edge toward the second end edge such that the wing is displaced out of a plane of the locking tab.

The third edge of the aperture may be provided by a shoulder which is located adjacent to the first end edge and which projects into the aperture.

The locking tab may be joined to the first panel along a fold line, and the wing may be partially severed from the locking tab by a slit extending from the fold line toward the free end edge of the locking tab.

The locking aperture may have a fourth edge disposed such that the first end edge of the aperture is interposed between the third and fourth edges. The fourth edge of the aperture may be offset from the first end edge toward the second end edge of the aperture. The locking tab may further include a second wing defined along the other side edge of the locking tab. The second wing may preferably have virtually the same structural features as the first wing. However, the second wing should be pressed against the fourth edge of the aperture rather than against the third edge.

The locking tab may further include an ear defined along the other side edge of the locking tab. The ear may project laterally from the other side edge to provide a stopper for preventing the locking tab from being withdrawn from the locking aperture. The width of the locking tab at the ear may preferably be greater than the maximum width of the locking aperture.

The present invention in a third form provides a carton blank which comprises first and second panels, a locking tab defined by a first continuous cut line in the first panel, and a retaining tab defined by a second continuous cut line in the second panel. The locking tab is foldably joined along a fold line to the first panel and extends to its free end edge opposed to the fold line. At least one of the opposite end portions of the cut line is turned inwardly of the locking tab toward the free end edge to define a wing extending away from the free edge of the locking tab along at least one of the opposite side edges of the locking tab. The one end portion is disposed astride the fold line of the locking tab and extends into the locking tab so that the wing is partially severed from the locking tab. When displaced from the plane of the second panel, the retaining tab defines in the second panel a locking aperture for receiving the locking tab. The second cut line includes an intermediate portion and a portion adjacent to the intermediate portion. The intermediate portion defines an end edge of the locking aperture for engagement with the locking tab when the locking tab is received in the locking aperture. The adjacent portion of the second cut line is substantially cranked to define a pressing edge of the locking aperture. This pressing edge is offset from the end edge of the aperture in a direction away from the end edge. By this means, the wing of the locking tab can be pressed against the pressing edge when the first end edge is brought into engagement with the locking tab.

Other advantages and objects of the present invention will be apparent from the following description, the accompanying drawings, and the appended claims.

DETAILED DESCRIPTION OF THE PREFERRED EMBODIMENT

Figure 1:
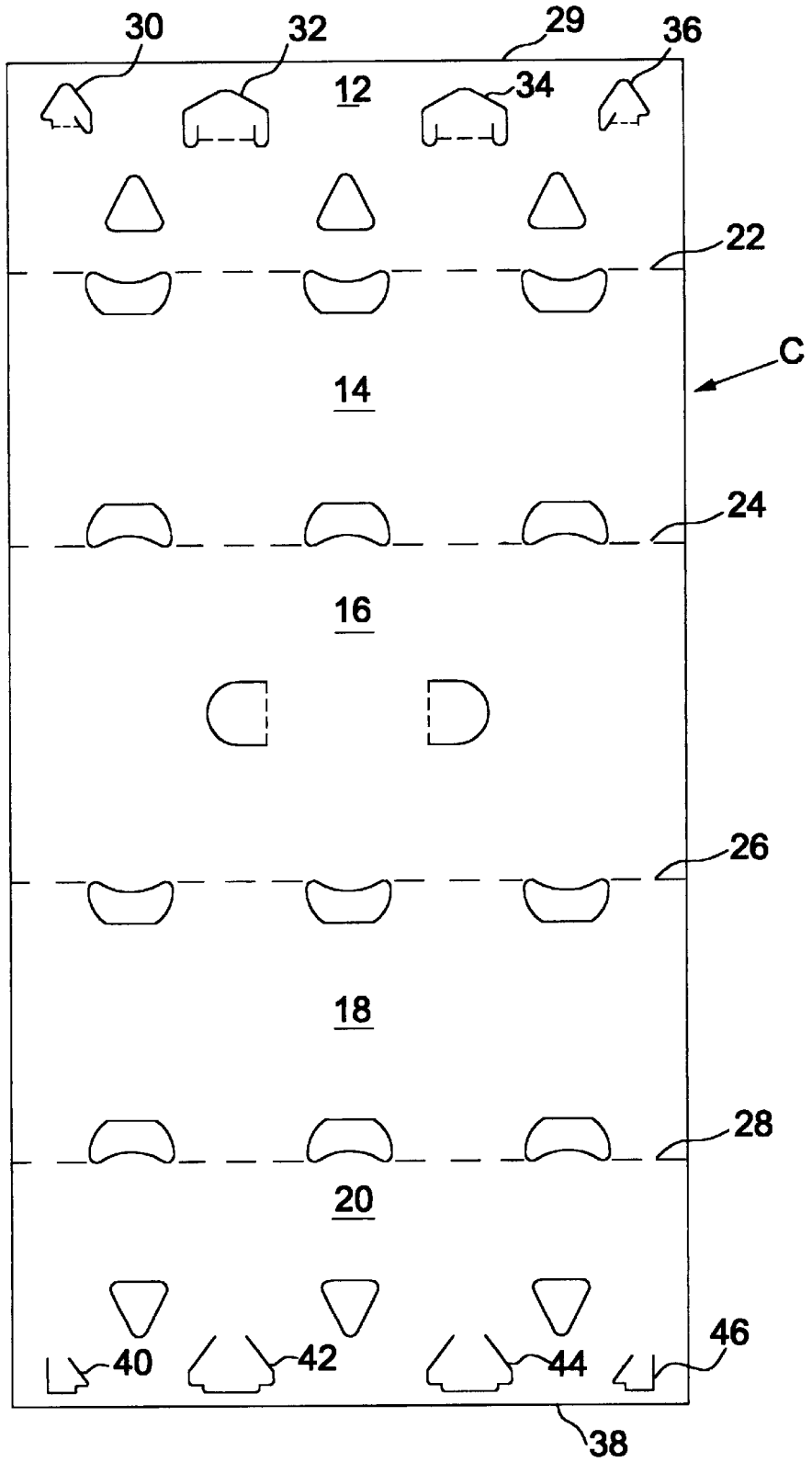
FIG. 1 is a plan view of a carton blank including an interlocking arrangement for panels in accordance with a preferred embodiment of the invention.

FIG. 1 illustrates a carton blank C which includes an interlocking arrangement for panels in accordance with a preferred embodiment of the invention. The carton blank C is formed of foldable material such as corrugated board, paperboard, plastic sheet or the like. The blank C is essentially rectangular in shape and comprises a series of panels foldably joined one to next. Described from top to bottom in FIG. 1, the panel series include a first bottom panel 12, a first side panel 14, a top panel 16, a second side panel 18, and a second bottom panel 20. The first bottom panel 12 is foldably joined to the first side panel 14 along a fold line 22. The first side panel 14 is foldably joined to one of the opposite side edges of the top panel 16 along a fold line 24. The top panel 16 is foldably joined at the other side edge thereof to the second side panel 18 along a fold line 26. The second side panel 18 is foldably joined to the second bottom panel 20 along a fold line 28.

The first bottom panel 12 is provided along the end edge 29 of the blank with a plurality of locking tabs 30, 32, 34 and 36. These locking tabs are struck from and foldably joined to the first bottom panel 12. The second bottom panel 20 is provided along the other end edge 38 of the blank with a plurality of retaining tabs 40, 42, 44 and 46. These retaining tabs are struck from and foldably joined to the second bottom panel 20. Each retaining tab, when folded out of the plane of the second bottom panel 20, leaves a locking aperture 90 (shown in FIGS. 4 and 5) in the second bottom panel 20. Each locking aperture is designed to receive one of the locking tabs at a location directly opposing the respective retaining tab. More specifically, the locking tabs 30, 32, 34 and 36 make pairs respectively with the retaining tabs 40, 42, 44 and 46, and each locking tab in cooperation with the pairing retaining tab serves as locking means for interlocking the first and second bottom panels 12 and 20 in an overlapping relationship. The locking tabs 30 and 36 are identical in size and shape to each other and so are the locking tabs 32 and 34. The retaining tabs 40 and 46 are identical in size and shape to each other and so are the retaining tabs 42 and 44. Accordingly, only the locking tabs 32 and 36 and the retaining tabs 42 and 46 will hereinafter be described.

Figure 2:
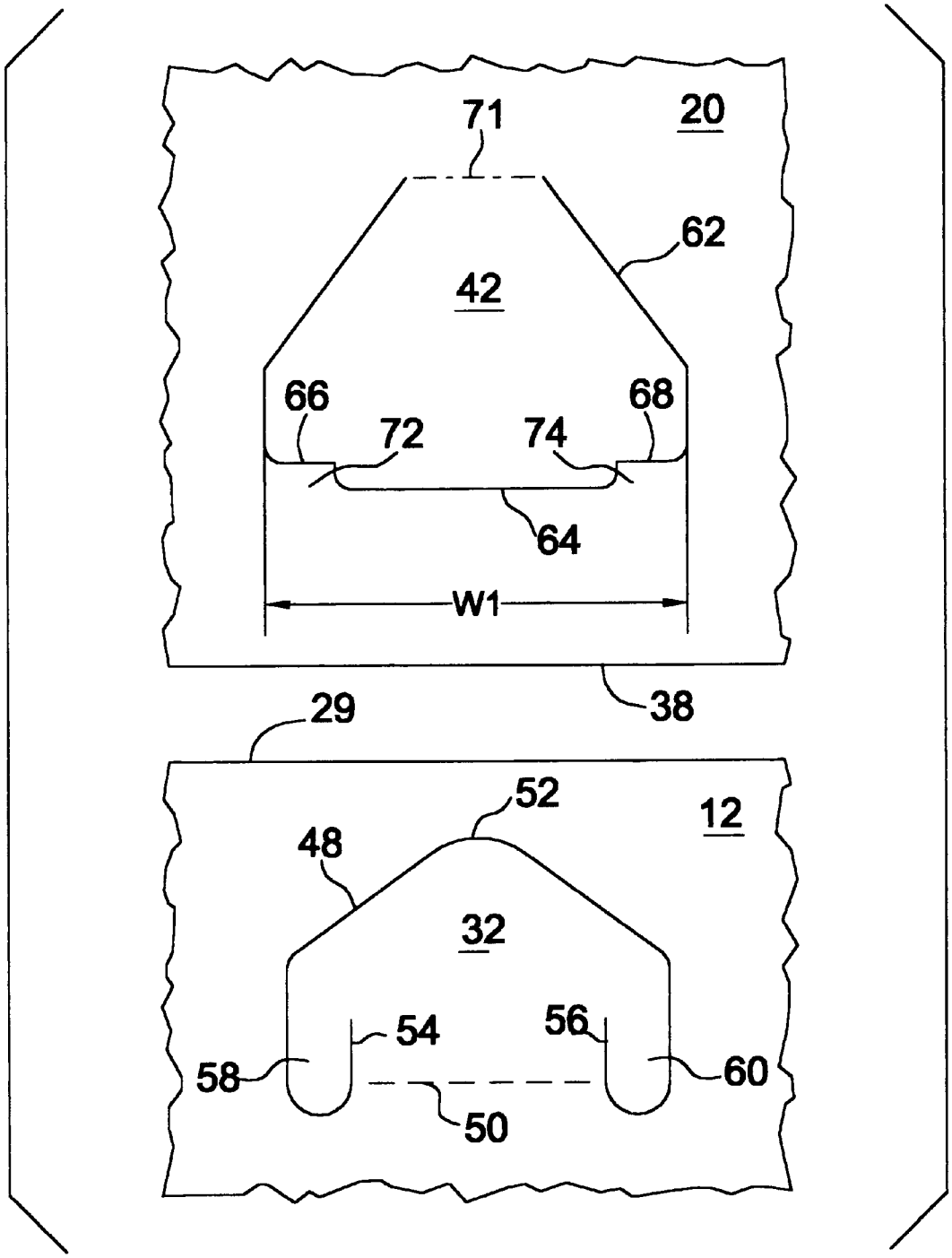
FIG. 2 is a plan view showing enlarged portions of the blank of FIG. 1 during carton formation, including a pair of locking and retaining tabs positioned for engagement.

Respective portions of the first and second bottom panels 12 and 20 are shown in greater detail in FIG. 2. The portion of the first bottom panel 12 includes the locking tabs 32 whereas the portion of the second bottom panel 20 includes the retaining tab 42. The first and second bottom panels 12 and 20 are positioned as they would appear during folding of the blank C to form the carton, just before they are overlapped with each other. During the process of overlapping the panels 12 and 20, the locking and retaining tabs 32 and 42 will be aligned with each other without changing their orientation as in FIG. 2.

The locking tab 32 is defined by an essentially U-shaped continuous cut line 48 in the first bottom panel 12. The base of the tab 32 is foldably joined to the first bottom panel 12 along a fold line 50. The tab 32 extends to an arched free end edge 52 defined by that portion of the cut line 48 opposed to the fold line 50. The opposite end portions 54 and 56 of the cut line 48 are turned inwardly of the locking tab toward the free end edge 52. These portions 54 and 56 are disposed astride the fold line 50 and extends substantially into the locking tab 32. By this means, wings 58 and 60 are defined along the opposite side edges of the locking tab 32, respectively. The wings 58 and 60 extend away from the free end edge 52 beyond the fold line 50 and are partially severed from the locking tab 32 by the end portions 54 and 56, respectively.

As further shown in FIG. 2, the retaining tab 42 is defined by an essentially U-shaped continuous cut line 62 in the second panel 20. The base of the retaining tab 42 is foldably joined to the second bottom panel 20 so that the retaining tab 42 will define a locking aperture in the panel 20 when folded and displaced from the plane of the panel 20. Although not shown in FIG. 2, a fold line may be formed along the base of the retaining tab 42 to facilitate folding of the tab 42. The cut line 62 includes an intermediate portion 64 and a pair of cranked portions 66 and 68 disposed at locations adjacent to and sandwiching the intermediate portion 64. The intermediate portion 64 defines an end edge 70 (shown in FIG. 4) of the locking aperture opposed to the aperture edge along which the retaining tab 42 is joined to the panel 20. The aperture edge is shown by a phantom line in FIG. 2 at the reference numeral "71" for illustration purpose only. The portions 66 and 68 of the cut line 62 are cranked as extending in the opposite directions from the intermediate portion 64. This creates shoulders 72 and 74 out of the panel 20 projecting into the locking aperture. The shoulders 72 and 74 provide the aperture with collinear pressing edges 76 and 78 (shown in FIG. 4) which are parallel to the end edge 70 and offset from the same in a direction away from the end edge 70. The total length of the end edge 70 and the pressing edges 76 and 78, i.e., the maximum width "W1" (shown in FIG. 2), of the locking aperture is substantially greater than the width of the locking tab 32 at the wings 58 and 60. This facilitates engagement of the pressing edges 76 and 78 (shown in FIG. 4) with the wings 58 and 60 that will be described later.

Figure 3:
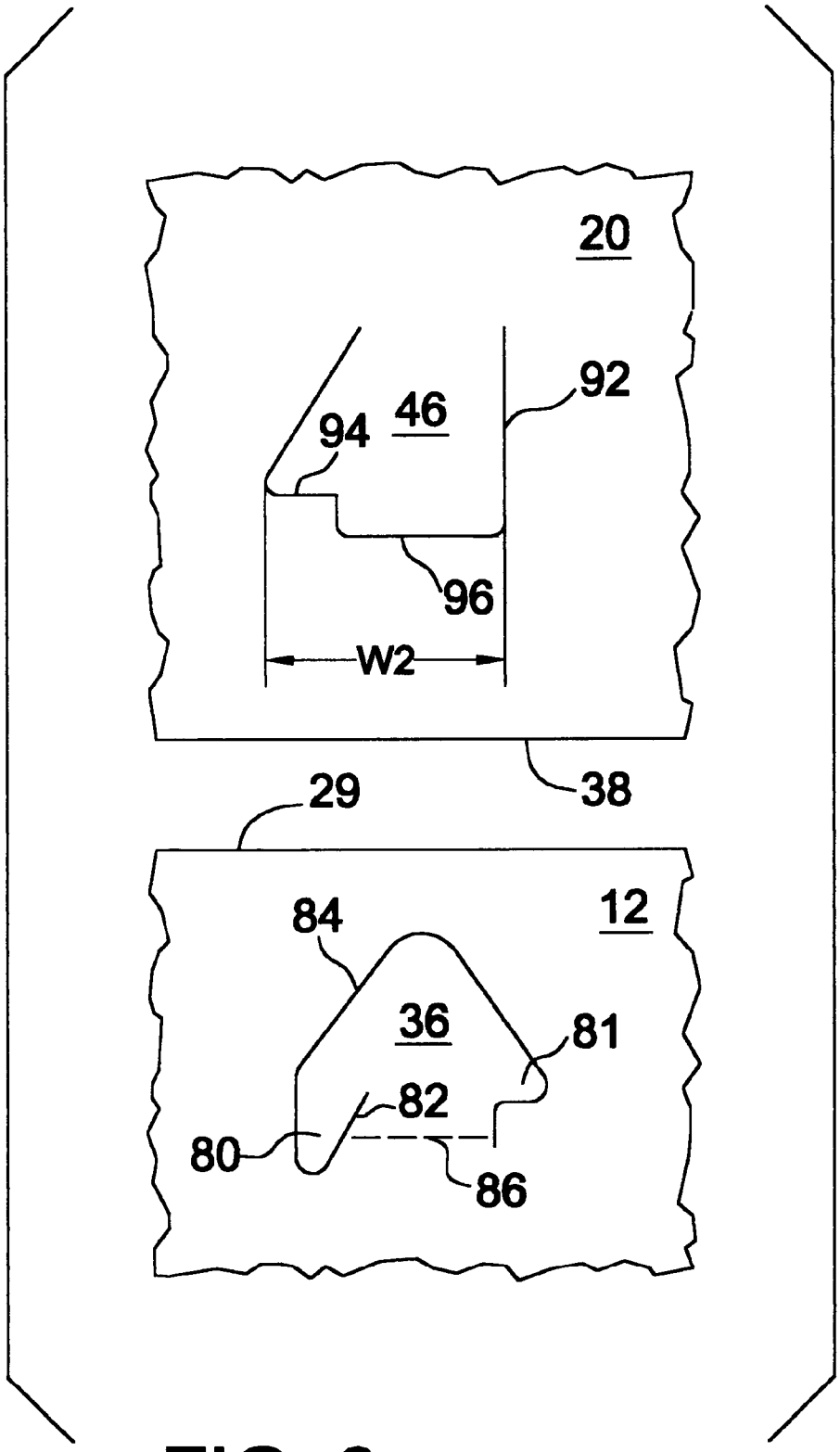
FIG. 3 is an enlarged plan view of other portions of the blank of FIG. 1 during carton formation, including locking and retaining tabs of another pair positioned for engagement.

FIG. 3 illustrates other portions of the first and second bottom panels 12 and 20 carrying the locking and retaining tabs 36 and 46, respectively. The first and second bottom panels 12 and 20 are positioned as they would appear during folding of the blank C to form the carton, just before they are overlapped with each other. The locking tab 36 is smaller in size than the locking tab 32. It further differs from the locking tab 32 in that it has only one wing 80 along a side edge thereof and an ear 81 along the other side edge. The wing 80 is defined by the inwardly turned end portion 82 of a continuous cut line 84. The end portion 82 defines an acute angle with the fold line 86 of the tab 36 rather than a right angle. The ear 81 projects laterally from the other side edge of the tab 36 to provide a stopper for preventing the tab 36 from being withdrawn from the locking aperture to be defined by the retaining tab 46.

The retaining tab 46 is smaller in size than the retaining tab 42. It further differs from the tab 42 in that the continuous cut line 92 for the tab 46 has only one cranked portion 94 adjacent to the intermediate portion 96. Further, the maximum width "W2" of the locking aperture to be defined by the tab 46 is substantially less than the width of the locking tab 36 at the ear 81 and is substantially greater than the width of the tab 36 at the fold line 86.

Figure 4:
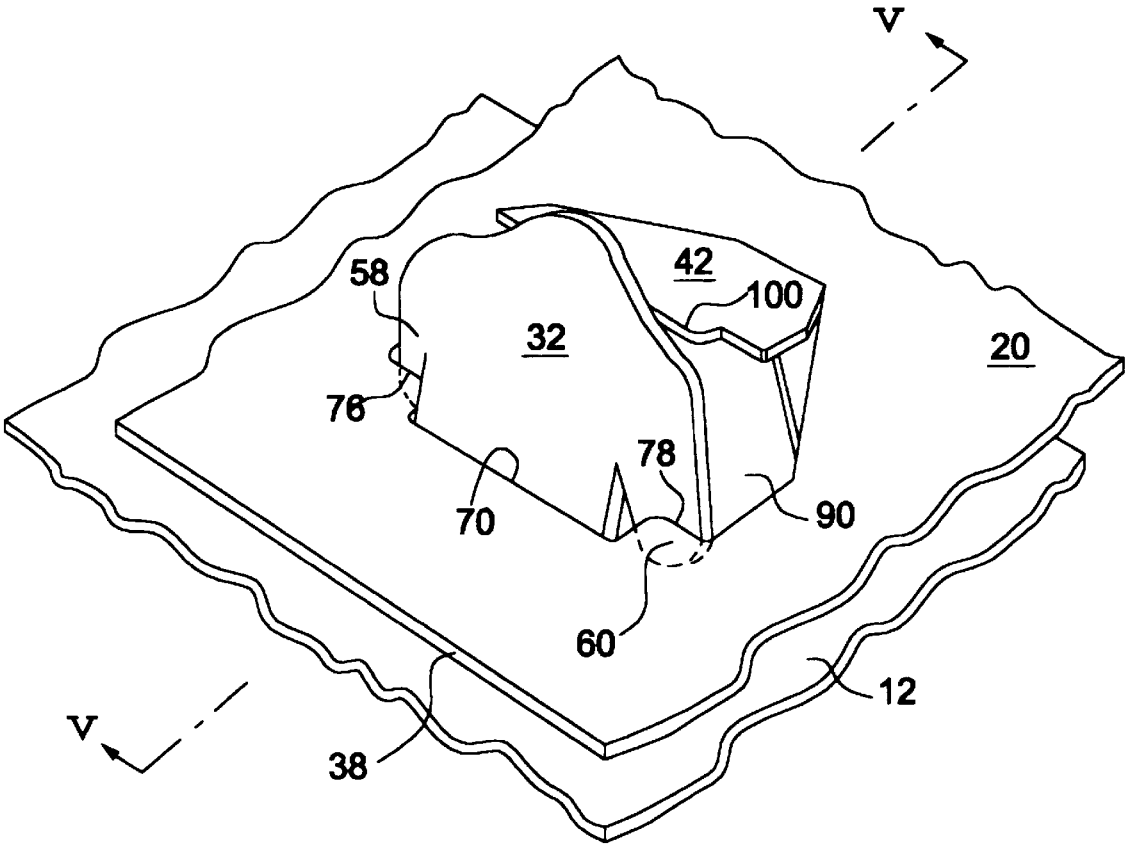
FIG. 4 is a perspective view showing the carton portions of FIG. 2 upon engagement of the tabs.

To form a carton, the blank C having the above locking means are supplied to a packaging machine and is placed over a group of articles. After the blank is disposed around the article group, the first and second bottom panels 12 and 20 are moved toward each other and thereby brought into an overlapping relationship as shown in FIG. 4. In this condition, the fold lines 50 and 86 of the locking tabs 32 and 36 are vertically aligned respectively with the intermediate portions 64 and 96 of the cut lines for the retaining tabs 42 and 46. The locking and retaining tabs of each aligned pair are then engaged together to interlock the first and second bottom panels 12 and 20 so that the panels 12 and 20 in cooperation form a composite bottom wall of the carton.

Figure 5:
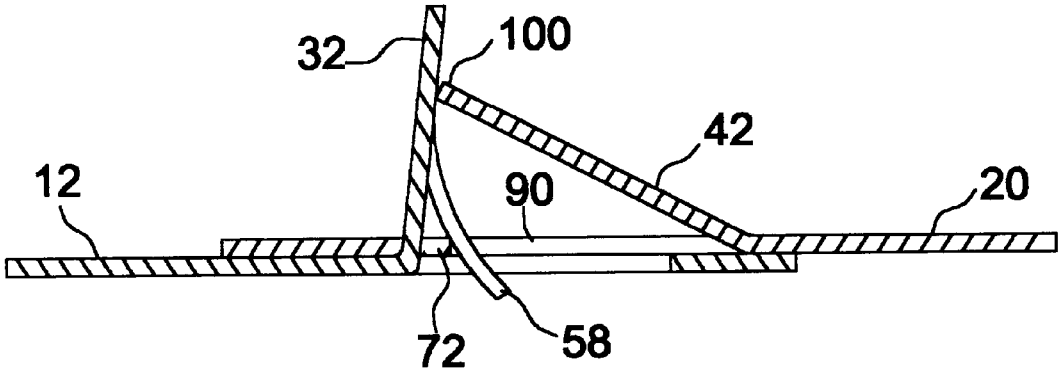
FIG. 5 is a view taken along the line V—V in FIG. 4.

Engagement of the locking and retaining tabs of each aligned pair is achieved typically by a part of a conventional packaging machine similar to the punching mechanism, which causes each locking tab to be inserted into the associated locking aperture. Using the locking means 32 and 42 as an example, such an inserting process is described hereinbelow. First, the locking tab 32 is folded relative to the first bottom panel 12. This thrusts the retaining tab 42 aside to cause a locking aperture 90 to open as well as to allow the locking tab 32 to enter the aperture 90. The locking tab 32 is folded far enough to clear the distal end edge 100 of the retaining tab 42, whereupon the retaining tab 42 brings the distal end edge 100 into abutment against one of the opposite side surfaces of the locking tab 32. This enables the retaining tab 42 to serve as a brace for supporting the locking tab 32 in its folded position as best shown in FIG. 5. In this folded position, the locking tab 32 is held in engagement at its base with the end edge 70 of the locking aperture 90 so that the panels 12 and 20 are secured together in an interlocked condition.

As folded, the locking tab 32 is also brought into engagement at the wings 58 and 60 with the pressing edges 76 and 78 (shown in FIG. 4). The wings 58 and 60 extend downwardly through the locking aperture 90 as best shown in FIG. 5, and are pressed against the pressing edges 76 and 78. As a result, the wings 58 and 60 are displaced out of the plane of the locking tab 32 to form additional braces for supporting the locking tab 32 in the folded position. These braces will resist unfolding of the locking tab 32 to ensure against disengagement of the panels 12 and 20.

The locking and retaining tabs 36 and 46 engage each other in a similar manner to the tabs 32 and 42 except that the ear 81 will engage the straight side edge of the associated locking aperture to inhibit the locking tab 36 from being inadvertently withdrawn from the locking aperture.

It will be recognized that although the foregoing embodiment shows a carton blank for forming a relatively simple wrap-around style carton, the interlocking arrangement of the present invention is usable in any carton or other application in which panels of sheet material are to be secured by means of a punch-type lock. In other words, the present invention is not limited to the blanks or cartons consisting of five panels such as shown in FIG. 1, but may be used with any wraparound cartons which include those having a pair of shoulder strips between the top panel and the opposite side panels, those having a pair of heel strips between the bottom wall and the side panels and those having both the shoulder and heel strips. The interlocking arrangement of the invention may be used even with non-wraparound type cartons as far as such cartons have a pair of overlapping panels which need to be interlocked. Such non-wraparound cartons should include multiple-piece cartons in which two or more blanks are interlocked to form a carton and tubular cartons in which at least one of its opposite open ends is closed by two or more overlapping end flaps.

It will be also recognized that as used herein, the terms "top", "bottom" and "side" with respect to the panels of the carton blank are relative terms, and that the carton formed from the blank may be re-oriented as necessary or as desired. Further, rather than the bottom wall being formed from the interlocked panels 12 and 20, it will be recognized that the carton blank may be rearranged whereby some other wall such as a top wall or a side wall is formed from the interlocked panels.

What is claimed is:

1. An interlocking arrangement for panels comprising:

a first panel;

a locking tab struck from said first panel, said locking tab being foldably joined along a fold line to said first panel and extending to a free end edge thereof opposed to said fold line, said locking tab including a wing defined along one of opposite side edges of said locking tab and extending away from said free edge beyond said fold line;

a second panel to be disposed in an overlapping relationship with said first panel;

a retaining tab struck from said second panel and defining in said second panel a locking aperture for receiving said locking tab, said locking aperture having a first end edge for engagement with said locking tab when said locking tab is received in said locking aperture and a second end edge opposed to said first end edge and foldably joined to said retaining tab, said retaining tab extending from said second end edge to a distal end edge thereof for engagement with one of opposite surfaces of said locking tab when said first end edge is brought into engagement with said locking tab; and means for pressing said wing toward said second end edge when said first end edge is brought into in engagement with said locking tab.

2. The interlocking arrangement according to claim 1, wherein said pressing means comprises a shoulder adjacent to said first end edge and projecting into said locking aperture.

3. The interlocking arrangement according to claim 2, wherein said shoulder comprises a pressing edge offset from said first end edge of said aperture toward said second end edge.

4. The interlocking arrangement according to claim 1, wherein said pressing means comprises a third edge of said locking aperture adjacent to said first end edge, said third edge being offset from said first end edge toward said second end edge.

5. The interlocking arrangement according to claim 1, wherein said wing is partially severed from said locking tab by a slit extending from said fold line toward said free end edge.

6. The interlocking arrangement according to claim 1, wherein said locking tab further includes a second wing defined along the other side edge of said locking tab and extending away from said free edge beyond said fold line, and second means is provided for pressing said second wing toward said second end edge when said first end edge is brought into engagement with said locking tab.

7. The interlocking arrangement according to claim 6, wherein the width of said locking tab at said wings is less than the maximum width of said locking aperture.

8. The interlocking arrangement according to claim 1, wherein said locking tab further includes an ear defined along the other side edge of said locking tab, said ear projecting laterally from said other side edge to provide a stopper for preventing said locking tab from being withdrawn from said locking aperture.

9. The interlocking arrangement according to claim 8, wherein the width of said locking tab at said ear is greater than the maximum width of said locking aperture.

10. A carton comprising first and second overlapping panels and locking means for securing said panels together, said locking means comprising:

a locking tab struck from said first panel, said locking tab being foldably joined to said first panel and extending to a free end edge thereof, said locking tab including a wing defined along one of opposite side edges of said locking tab and extending away from said free edge; and a retaining tab struck from said second panel and defining a locking aperture in said second panel, said locking aperture having first and second opposed end edges and a third edge adjacent to said first end edge and offset from said first end edge toward said second end edge, said retaining tab being foldably joined to said second panel along said second end edge and extending to a distal end edge thereof, wherein said locking tab is disposed in a folded position where said locking tab is received in said locking aperture and in engagement with said first end edge of said aperture, wherein said retaining tab is disposed in a folded position where said retaining tab is in engagement at said distal end edge thereof with one of opposite surfaces of said locking tab whereby said locking tab is retained in said folded position thereof, and wherein said wing of said locking tab extends through said locking aperture and is pressed against said third edge to assist in retaining said locking tab in said folded position thereof.

11. The carton according to claim 10, wherein said wing of said locking tab is pressed by said third edge toward said second end edge such that said wing is displaced out of a plane of said locking tab.

12. The carton according to claim 10, wherein said third edge of said locking aperture is provided by a shoulder adjacent to said first end edge and projecting into said locking aperture.

13. The carton according to claim 10, wherein said locking tab is joined to said first panel along a fold line, and said wing is partially severed from said locking tab by a slit extending from said fold line toward said free end edge of said locking tab.

14. The carton according to claim 10, wherein said locking aperture has a fourth edge disposed such that said first end edge is interposed between said third and fourth edges, said fourth edge being offset from said first end edge toward said second end edge, and said locking tab further includes a second wing defined along the other side edge of said locking tab and extending away from said free edge through said locking aperture, said second wing being pressed against said fourth edge to assist in retaining said locking tab in said folded position thereof.

15. The carton according to claim 10, wherein said locking tab further includes an ear defined along the other side edge of said locking tab, said ear projecting laterally from said other side edge to provide a stopper for preventing said locking tab from being withdrawn from said locking aperture.

16. The interlocking arrangement according to claim 15, wherein the width of said locking tab at said ear is greater than the maximum width of said locking aperture.

17. A carton blank comprising:

a first panel;

a locking tab defined by a first continuous cut line in said first panel, said locking tab being foldably joined along a fold line to said first panel and extending to a free end edge thereof opposed to said fold line, at least one of opposite end portions of said cut line being turned inwardly of said locking tab toward said free end edge such that a wing extending away from said free edge is defined by said one end portion along at least one of opposite side edges of said locking tab, said one end portion being disposed astride said fold line and extending into said locking tab so that said wing is partially severed from said locking tab;

a second panel; and a retaining tab defined by a second continuous cut line in said second panel, said retaining tab when displaced defining in said second panel a locking aperture for receiving said locking tab, said second cut line including an intermediate portion and a portion adjacent thereto, said intermediate portion defining an end edge of said locking aperture for engagement with said locking tab when said locking tab is received in said locking aperture, said adjacent portion being substantially cranked to define a pressing edge of said locking aperture, said pressing edge being offset from said end edge in a direction away from said end edge whereby said wing of said locking tab is pressed against said pressing edge when said first end edge is brought into engagement with said locking tab.

* * * * *